US011103085B2

(12) United States Patent
Tan

(10) Patent No.: US 11,103,085 B2
(45) Date of Patent: Aug. 31, 2021

(54) INCLINED POCKETED SPRING STRING AND POCKETED SPRING BED CORE

(71) Applicant: GUANGZHOU LIANROU MACHINERY AND EQUIPMENT CO., LTD, Guangzhou (CN)

(72) Inventor: Zhiming Tan, Guangzhou (CN)

(73) Assignee: GUANGZHOU LIANROU MACHINERY AND EQUIPMENT CO., LTD., Ghangzhou (CN)

( * ) Notice: Subject to any disclaimer, the term of this patent is extended or adjusted under 35 U.S.C. 154(b) by 1 day.

(21) Appl. No.: 16/642,981

(22) PCT Filed: Feb. 28, 2018

(86) PCT No.: PCT/CN2018/077471
§ 371 (c)(1),
(2) Date: Feb. 28, 2020

(87) PCT Pub. No.: WO2019/052122
PCT Pub. Date: Mar. 21, 2019

(65) Prior Publication Data

US 2020/0253390 A1 Aug. 13, 2020

(30) Foreign Application Priority Data

Sep. 15, 2017 (CN) ..... 201710833498.3

(51) Int. Cl.
*A47C 27/07* (2006.01)
*A47C 27/045* (2006.01)
*A47C 27/06* (2006.01)

(52) U.S. Cl.
CPC ..... *A47C 27/07* (2013.01); *A47C 27/045* (2013.01); *A47C 27/064* (2013.01)

(58) Field of Classification Search
CPC ..... A47C 27/07; A47C 27/06; A47C 27/045; A47C 27/064
See application file for complete search history.

(56) References Cited

U.S. PATENT DOCUMENTS 4,234,984 A * 11/1980 Stumpf ..... A47C 27/063 5/655.8
4,523,344 A * 6/1985 Stumpf ..... A47C 27/064 5/655.8

FOREIGN PATENT DOCUMENTS

| | | | |
|---|---|---|---|
| CN | 2834320 | Y | 11/2006 |
| CN | 103075454 | A | 5/2013 |
| CN | 202991991 | U | 6/2013 |
| CN | 103653964 | A | 3/2014 |

(Continued)

*Primary Examiner* — Fredrick C Conley
(74) *Attorney, Agent, or Firm* — Jason P. Mueller; FisherBroyles, LLP

(57) ABSTRACT

An inclined pocketed spring string (4) and a pocketed spring bed core (3). The inclined pocketed spring string (4) comprises a plurality of pocketed individual springs (1) connected at intervals. Each pocketed individual spring (1) comprises a fabric (11) and an individual spring (12) packaged in the fabric (11). The individual springs (12) in the pocketed spring string (4) are entirely or partially inclined in the fabrics (11) in an inclined manner. The inclined pocketed spring string (4) and the pocketed spring bed core (3) of the present invention, as compared with the pocketed spring bed core of the same size, can effectively decrease the number of springs used and reduce manufacturing costs.

7 Claims, 5 Drawing Sheets

(56) References Cited

FOREIGN PATENT DOCUMENTS

| | | | |
|---|---|---|---|
| CN | 107518674 | A | 12/2017 |
| EP | 2105069 | A1 | 9/2009 |
| GB | 0506593 | | 5/2005 |

* cited by examiner

INCLINED POCKETED SPRING STRING AND POCKETED SPRING BED CORE

CROSS-REFERENCE TO RELATED APPLICATIONS

The present application is a national stage entry under 35 U.S.C. 371 of PCT Patent Application No. PCT/CN2018/077471, filed Feb. 28, 2018, which claims priority to Chinese Patent Application No. 201710833498.3, filed Sep. 15, 2017, the entire contents of each of which are incorporated herein by reference.

TECHNICAL FIELD

The present invention relates to the field of pocketed springs and pocketed spring mattresses, in particular to an inclined pocketed spring string and a pocketed spring bed core.

BACKGROUND

A pocketed spring string is formed by sequentially and independently packaging a plurality of springs in fabrics side by side, and generally, the compression direction of the springs is perpendicular to the upper and lower end faces of the pocketed spring string; and then, the pocketed spring strings are arrayed and bonded into a whole to form a pocketed spring mattress. The pocketed spring mattress of such a structure has good support performance and is comfortable; however, due to the fact that a large number of pocketed springs are used, production costs are high, and production efficiency is low.

SUMMARY

The technical issue to be settled by the present invention is to provide a pocketed spring string and a pocketed spring bed core which are low in cost, stable in structure and comfortable.

One technical solution adopted by the present invention to settle the above technical issue is as follows: an inclined pocketed spring string comprises a plurality of pocketed springs connected at intervals, wherein each pocketed spring comprises a fabric and a spring packaged in the fabric, and the springs in the pocketed spring string are entirely or partially inclined in the fabrics.

Furthermore, the inclined pocketed springs are sequentially arranged in an herringbone shape.

Furthermore, a packaging weld joint at an upper and/or lower end of each inclined pocketed springs is perpendicular to upper and lower end faces of the pocketed spring string.

Furthermore, the pocketed spring string is formed of inclined pocketed springs and common upright pocketed springs perpendicular to upper and lower end faces of the pocketed spring string.

Furthermore, a first pocketed spring and a last pocketed spring of the pocketed spring string are commonly upright pocketed springs perpendicular to upper and lower end faces of the pocketed spring string.

Another technical solution adopted by the present invention to settle the above technical issue is as follows: an inclined pocketed spring bed core is formed by sequentially bonding multiple rows of the of pocketed spring strings mentioned above.

Furthermore, the pocketed spring strings are bonded in a manner that each adjacent two pocketed spring strings are staggered.

The present invention has the following beneficial effects: the pocketed spring string and the pocketed spring bed core of the present invention, as compared with traditional pocketed spring bed cores, effectively decrease the number of springs used; the springs are sequentially arrayed in a herringbone shape and are bonded in a staggered manner, so that the number of springs is decreased, and the structural stability of the bed core and uniform support of a whole mattress are guaranteed; through the design that has a small section at the upper and/or lower end of each pocketed spring that is perpendicular to the upper and lower end faces of the pocketed spring string, the pocketed springs are firmer in structure, the surface of the bed core is kept flat to the maximum extent, and the comfort of the mattress is improved. Therefore, the inclined pocketed spring string and the pocketed spring bed core of the present invention, as compared with pocketed spring bed cores of the same size, can effectively decrease the number of springs used and reduce manufacturing costs.

DETAILED DESCRIPTION OF EMBODIMENTS

Figure 1:
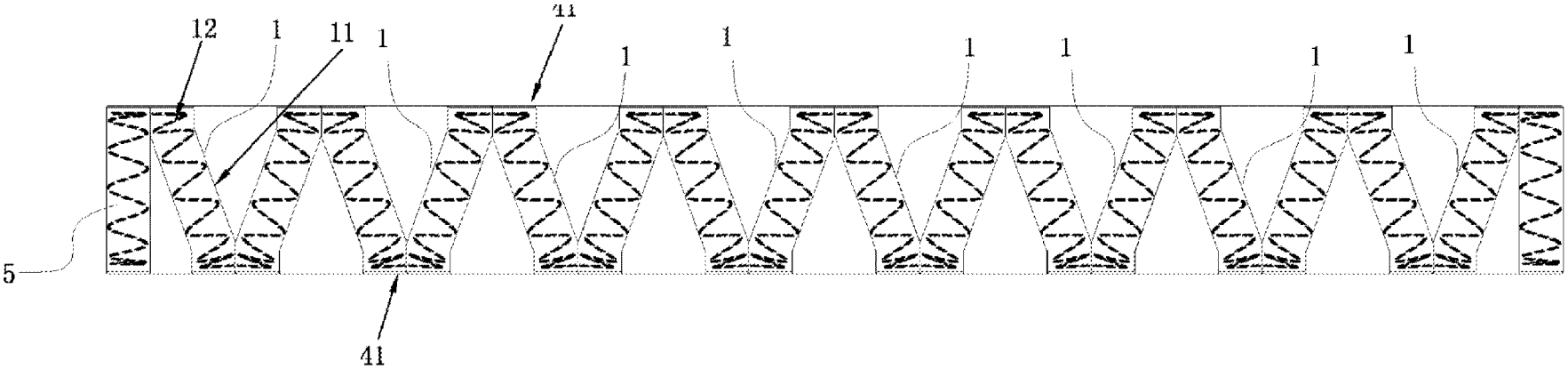
FIG. 1 is a structural view of an inclined pocketed spring string of the present invention.
Figure 2:
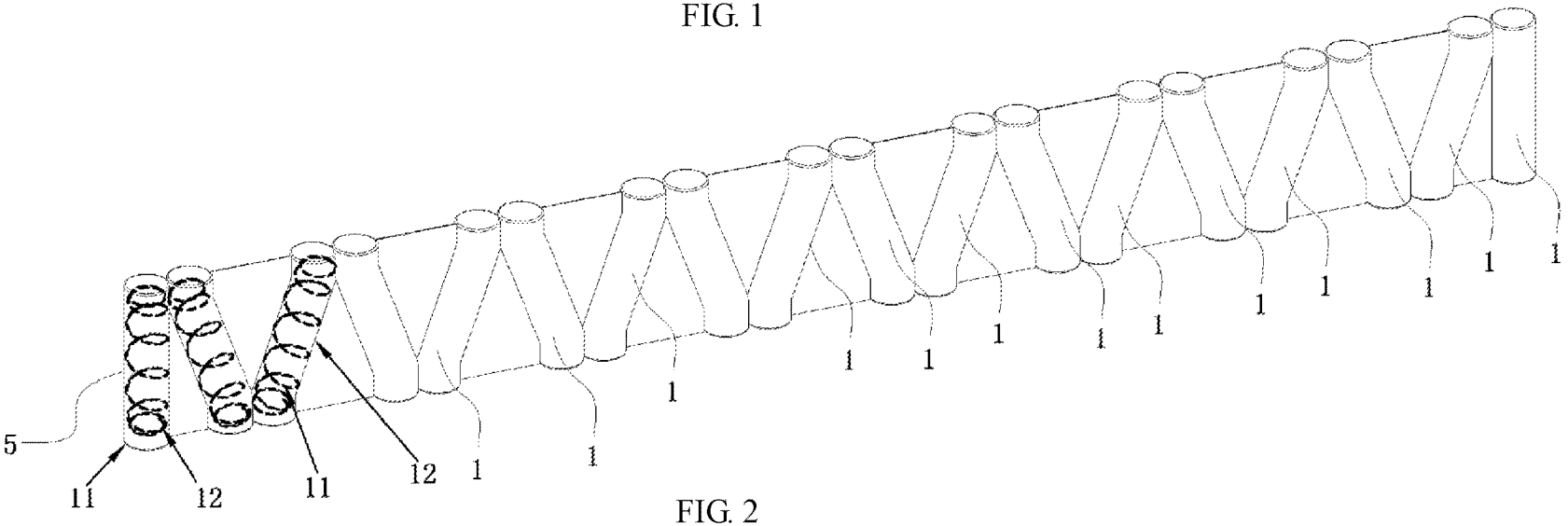
FIG. 2 is a perspective view of FIG. 1.

The present invention is further detailed below with reference to the accompanying drawings As shown in FIG. 1 and FIG. 2, an inclined pocketed spring string comprises a plurality of pocketed individual springs 1 connected at intervals, wherein each pocketed spring comprises a fabric 11 and a individual spring 12 packaged in the fabric, and the individual springs 12 in the pocketed spring string 4 are entirely or partially packaged in the fabrics 11 in an inclined manner.

In this embodiment, the inclined pocketed individual springs 1 in the inclined pocketed spring string 4 are sequentially arrayed in a herringbone shape. A packaging weld joint at an upper and/or lower end of each inclined pocketed individual spring 1 is perpendicular to upper and lower end faces 41 of the pocketed spring string. The first pocketed spring and the last pocketed spring of the pocketed spring string are common upright pocketed individual springs 5 perpendicular to the upper and lower end faces 41 of the pocketed spring string, so that front and back ends are flat structures.

Figure 3:
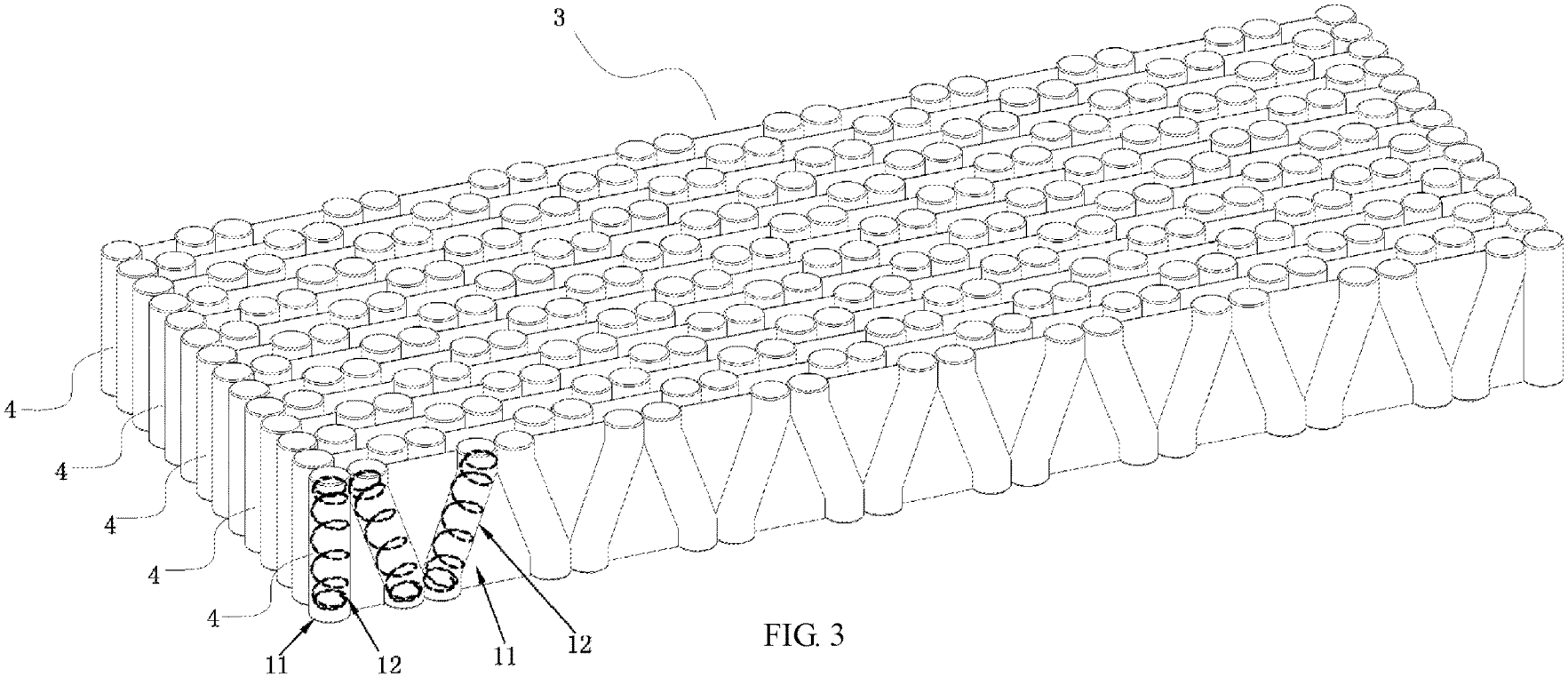
FIG. 3 is a structural view of an inclined pocketed spring bed core of the present invention.
Figure 4:
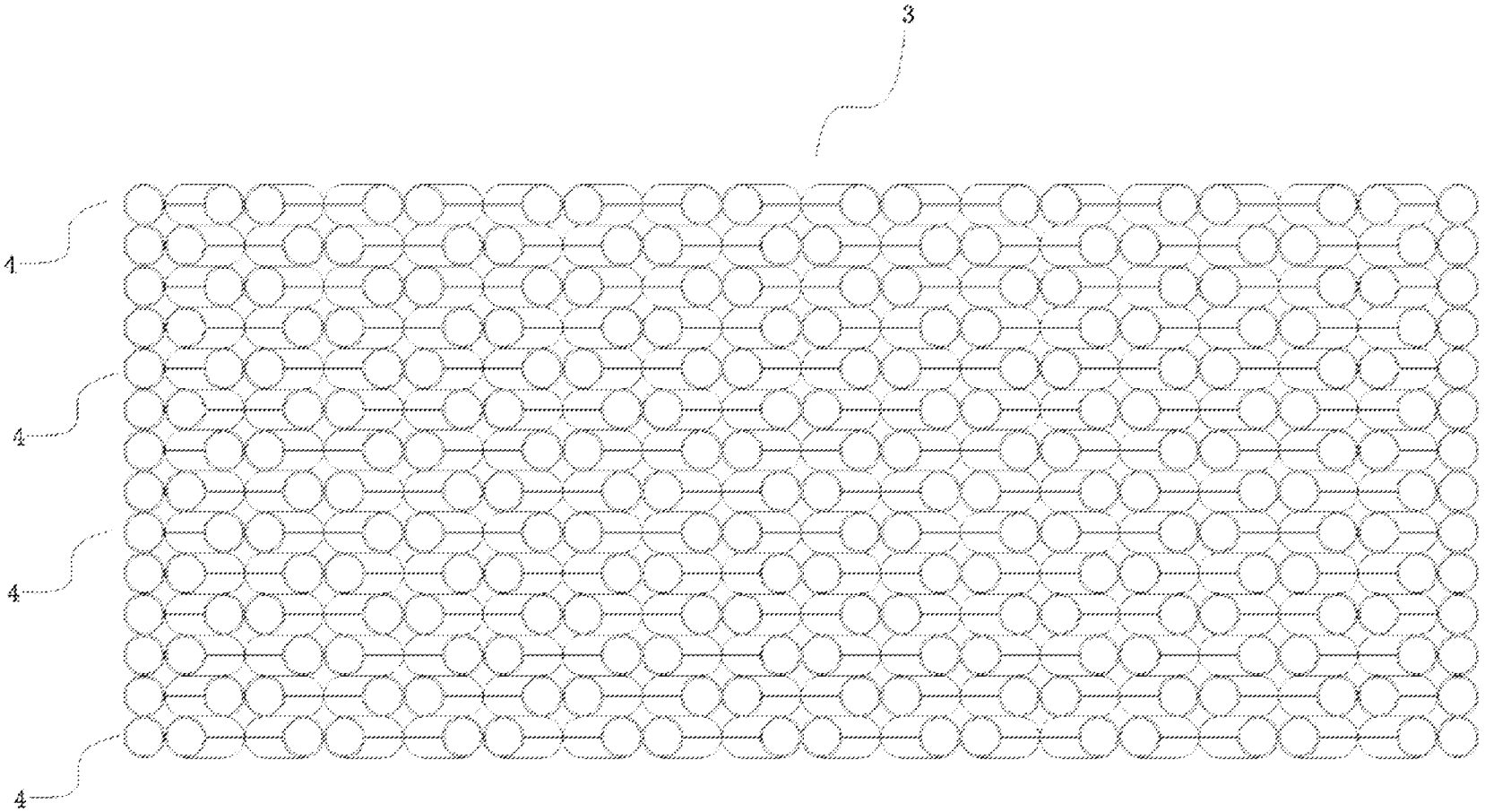
FIG. 4 is a top view of FIG. 3.

As shown in FIG. 3 and FIG. 4, an inclined pocketed spring bed core 3 is formed by sequentially bonding a plurality of pocketed spring strings 4 and is of large planar bed core structure, and the size of the bed core depends on the number of pocketed spring strings 4 which are bonded together. The pocketed spring strings 4 are bonded in a manner that every two pocketed spring strings are staggered, so that the bed core has higher compressive strength, is better protected against deformation, and more conformable to use.

Figure 5:
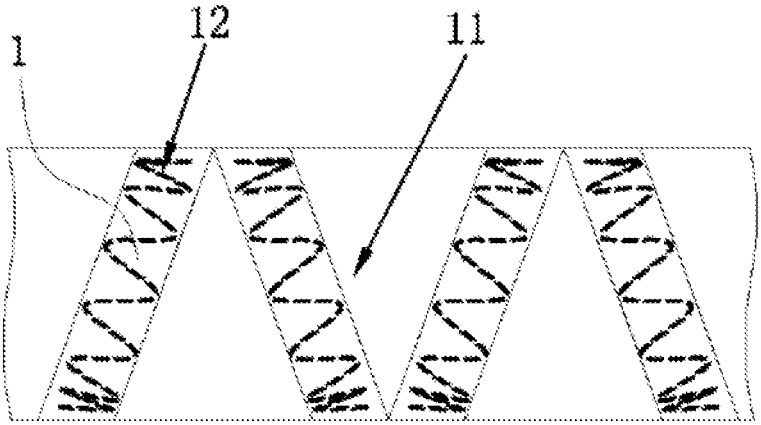
FIG. 5 is another structural view of the inclined pocketed spring string of the present invention.
Figure 6:
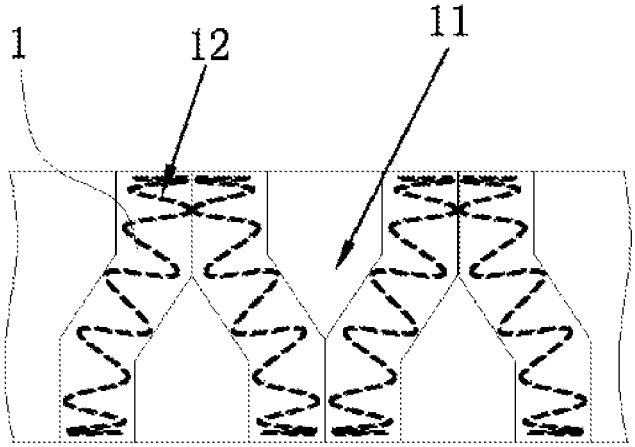
FIG. 6 is another structural view of the inclined pocketed spring string of the present invention.
Figure 7:
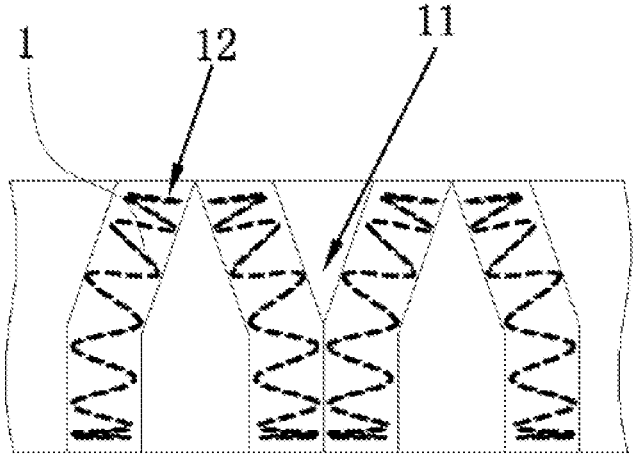
FIG. 7 is another structural view of the inclined pocketed spring string of the present invention.

FIG. 5, FIG. 6 and FIG. 7 show several other structures of the inclined pocketed spring string.

The embodiments of the present invention are detailed above with reference to the accompanying drawings, but the present invention is not limited to the above-mentioned embodiments. Various transformations can be made by those skilled in the art within their knowledge scope without deviating from the spirit of the present invention.

What is claimed is:

1. An inclined pocketed spring string, comprising a plurality of inclined pocketed individual springs arranged sequentially, wherein any two adjacent inclined pocketed individual springs are connected such that an end of a first spring is connected to an end of a second spring, each of the inclined pocketed individual springs comprises a fabric and an individual spring packaged in the fabric, and the individual spring is entirely or partially inclined in the fabric.

2. The inclined pocketed spring string of claim 1, wherein the inclined pocketed individual springs are sequentially arranged in a herringbone shape.

3. The inclined pocketed spring string of claim 1, further comprising a packaging weld joint that connects the inclined pocketed spring to another inclined pocketed individual spring located at an upper end and/or a lower end of each of the inclined pocketed individual springs, wherein the packaging weld joint is perpendicular to an upper end face and a lower end face of the pocketed spring string.

4. The inclined pocketed spring string of claim 1, wherein the pocketed spring string is formed of the inclined pocketed individual springs and common upright pocketed individual springs perpendicular to an upper end face and a lower end face of the pocketed spring string.

5. The inclined pocketed spring string of claim 1, wherein a first pocketed individual spring and a last pocketed individual spring of the pocketed spring string are common upright pocketed springs perpendicular to an upper end face and a lower end face of the pocketed spring string.

6. An inclined pocketed spring bed core, being formed by sequentially bonding a multiple rows of the pocketed spring strings of claim 1.

7. The inclined pocketed spring bed core of claim 6, wherein the pocketed spring strings are bonded in a manner that each adjacent two of the pocketed spring strings are staggered.

* * * * *